US009760104B2

(12) United States Patent
Kadanka

(10) Patent No.: US 9,760,104 B2
(45) Date of Patent: Sep. 12, 2017

(54) BULK CURRENT REGULATION LOOP

(71) Applicant: SEMICONDUCTOR COMPONENTS INDUSTRIES, LLC, Phoenix, AZ (US)

(72) Inventor: Petr Kadanka, Valasska Bystrice (CZ)

(73) Assignee: Semiconductor Components Industries, LLC, Phoenix, AZ (US)

( * ) Notice: Subject to any disclaimer, the term of this patent is extended or adjusted under 35 U.S.C. 154(b) by 31 days.

(21) Appl. No.: 14/833,229

(22) Filed: Aug. 24, 2015

(65) Prior Publication Data

US 2017/0060153 A1 Mar. 2, 2017

(51) Int. Cl.

| | |
|---|---|
| ***G05F 1/56*** | (2006.01) |
| ***G05F 1/575*** | (2006.01) |
| ***G05F 1/565*** | (2006.01) |

(52) U.S. Cl.

CPC ..... *G05F 1/575* (2013.01); *G05F 1/565* (2013.01)

(58) Field of Classification Search

None

See application file for complete search history.

(56) References Cited

U.S. PATENT DOCUMENTS

| | | | | |
|---|---|---|---|---|
| 5,689,144 | A * | 11/1997 | Williams | H01L 29/0847 307/130 |
| 2006/0033571 | A1* | 2/2006 | Killat | H03F 3/45183 330/253 |
| 2010/0156389 | A1* | 6/2010 | Oswal | G05F 3/262 323/316 |
| 2010/0289563 | A1* | 11/2010 | Katz | G05F 3/262 327/543 |
| 2015/0115918 | A1* | 4/2015 | Oikarinen | G05F 1/575 323/280 |
| 2015/0145594 | A1* | 5/2015 | Scott | H03F 1/0272 330/2 |

* cited by examiner

*Primary Examiner* — Jeffrey Gblende
(74) *Attorney, Agent, or Firm* — Iselin Law, PLLC

(57) ABSTRACT

An illustrative method embodiment includes: sensing a source-drain current provided by the output transistor; and controlling a bulk current from a body terminal of the output transistor in response to the source-drain current. The controlling includes: maintaining the bulk current at an operating value while the source-drain current is in an active range; and reducing the bulk current below the operating value when the source-drain current lies outside the active range. An illustrative circuit embodiment includes: an output transistor that supplies an output current over a range that includes an active region; and a bulk current adapter that senses the output current and responsively controls a bulk current from a body terminal of the output transistor, maintaining the bulk current at an operating value while the output current is in the active region and reducing the bulk current when the output current is outside the active region.

17 Claims, 2 Drawing Sheets

$V_c$
$M_{15}$
$M_{14}$
$M_{13}$
$M_{16}$
$M_S$
$M_{17}$
$M_{out}$
$V_{bulk}$
IN
$M_0$
$M_1$
$C_0$
I-bulk adapter
$R_0$
FB
$M_4$
$M_9$
OUT
$I_{bias}$
$I_{bias}$
$I_{bulk}$
$M_2$
$M_3$
$M_6$
$M_7$
$M_{leak}$
GND $I_{bulk}$
$I_A$
$I_Q$
STANDBY
ACTIVE
$I_{out}$ SUPPLY OUTPUT CURRENT WITH OUTPUT TRANSISTOR
502
SENSE OUTPUT CURRENT
504
DERIVE BULK CURRENT VALUE FOR SENSED OUTPUT CURRENT
506
ADAPT BULK CURRENT TO VALUE
508

BULK CURRENT REGULATION LOOP

BACKGROUND

Electronic system designers needing voltage regulation often employ low-dropout ("LDO") regulators, as these regulators offer a desirable combination of features. For example, LDO regulators can offer high-performance regulation over a wide range of load currents even when the supply voltage is very close to the output voltage. As they are linear voltage regulators, they do not require rapid switching and hence they produce no switching noise. Their relatively simple architecture requires no inductors or transformers, enabling them to be implemented with a relatively small device size. Nevertheless, an even smaller size would be desirable, so long as it can be achieved without sacrificing regulator performance or efficiency.

SUMMARY

Accordingly, there is disclosed herein a bulk-current regulation technique for improving output transistor performance, which in the context of an LDO regulator, reduces dropout without requiring a larger transistor and without sacrificing efficiency by, e.g., reducing threshold voltage and thereby increasing leakage current. An illustrative method embodiment includes: sensing a source-drain current provided by the output transistor; and controlling a bulk current from a body terminal of the output transistor in response to the source-drain current. The controlling includes: maintaining the bulk current at an operating value while the source-drain current is in an active range; and reducing the bulk current below the operating value when the source-drain current lies outside the active range.

An illustrative circuit embodiment includes: an output transistor that supplies an output current over a range that includes an active region; and a bulk current adapter that senses the output current and responsively controls a bulk current from a body terminal of the output transistor, maintaining the bulk current at an operating value while the output current is in the active region and reducing the bulk current when the output current is outside the active region. The illustrative circuit may be implemented as part of a low dropout (LDO) regulator.

It should be understood that the drawings and corresponding detailed description do not limit the disclosure, but on the contrary, they provide the foundation for understanding all modifications, equivalents, and alternatives falling within the scope of the appended claims.

DETAILED DESCRIPTION

The output transistor(s) of devices such as LDO regulators are often required to supply significant currents with a minimal voltage drop. The device specifications may accordingly require that the transistor size be undesirably large and/or be provided with an undesirably low threshold current. To relax these limits, the present disclosure modifies the bulk current of the device, preferably in an adaptive fashion that preserves the device's efficiency at low output currents.

Figure 1:
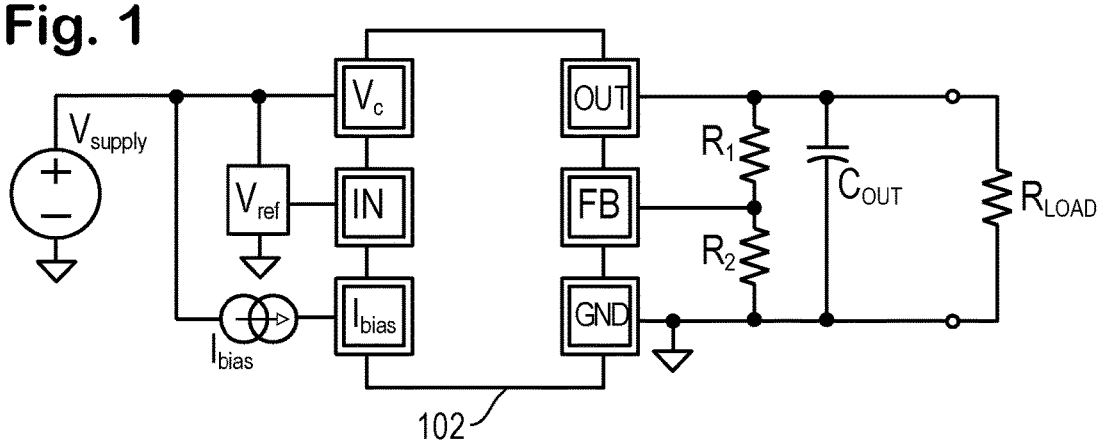
FIG. 1 is an illustrative application schematic for an LDO regulator.

To provide an illustrative context, FIG. 1 shows an LDO regulator application schematic. An illustrative output stage of an LDO regulator device 102 is shown with six pins, including a supply voltage pin Vc and ground pin GND. An input pin IN accepts a reference voltage signal from a voltage reference (e.g., a Zener diode), and an optional feedback pin FB accepts a feedback voltage signal that can be compared with the reference voltage signal to regulate the output voltage signal provided on output pin OUT. An optional bias current pin Ibias accepts a bias current signal that a designer can employ to optimize a tradeoff between power efficiency and responsiveness of the regulator to perturbations.

The application schematic shows a power supply Vsupply coupled between the ground and the supply voltage pin Vc. A voltage reference is also coupled between the ground and the supply voltage to supply a reference voltage signal to the input pin IN. A current source is coupled to the Ibias pin. On the output side, an output capacitor Cout is coupled between ground and the output pin OUT, and a (variable) load resistance Rload is coupled in parallel with the output capacitor Cout. Two resistors R1, R2 are coupled in series between ground and the output pin OUT to form a voltage divider. The intermediate node of the voltage divider is coupled to the feedback pin FB.

Figure 2:
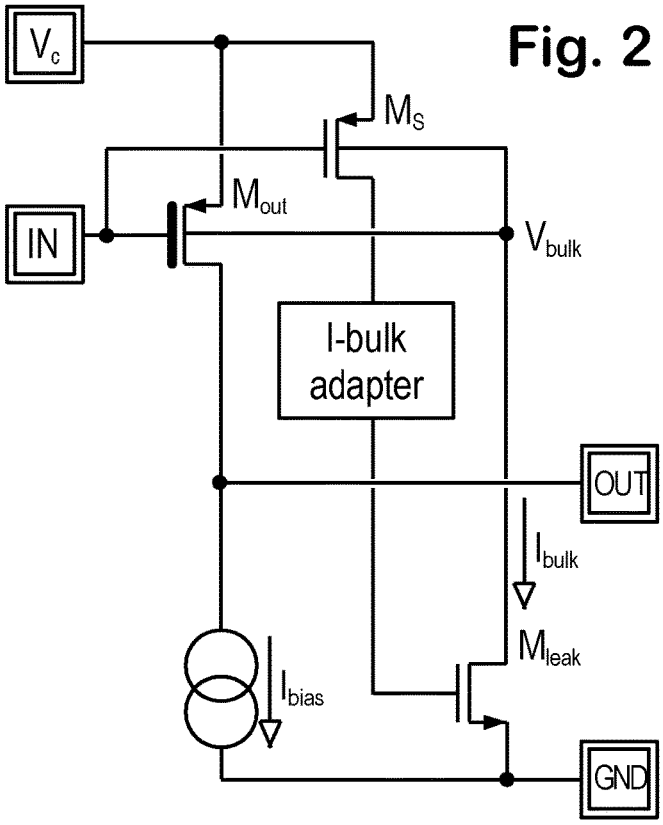
FIG. 2 shows an illustrative bulk current regulation loop for improving output transistor performance.

With this figure as context, we turn to FIG. 2, which shows a basic LDO regulator with an integrated bulk current regulation loop to improve output transistor performance. (While the embodiment of FIG. 2 lacks the optional feedback and bias current pins, they are included in the embodiment of FIG. 3.) A metal-oxide-semiconductor ("MOS") transistor having a p-type channel ("PMOS") is coupled between the supply voltage pin Vc and the output pin OUT to act as the output transistor Mout. The output current supplied by the output transistor is the source-drain current of the output transistor. The gate of the output transistor is coupled to the input pin IN. To increase the responsiveness of the device, a current sink draws a bias current Ibias from the output node.

MOS transistors are fundamentally four-terminal devices, having a source terminal, a drain terminal, a gate terminal, and a body terminal. Though the body terminal is normally shorted to the source terminal, it need not be. Rather, the body terminal can be driven separately to modify the transistor's threshold voltage. In the regulator of FIG. 2, the output transistor's body node is coupled to the node Vbulk. An n-channel leakage transistor Mleak is coupled between ground and the bulk node Vbulk, controlling flow of a bulk current Ibulk to maintain the desired bulk node voltage.

To regulate the bulk current Ibulk (and thereby control the voltage of the bulk node and body terminal of the output transistor), the regulator of FIG. 2 employs a sense transistor Ms and bulk current adapter block. The sense transistor Ms is PMOS, like the output transistor, with a source terminal coupled to the supply voltage pin Vc and a gate coupled to the gate of the output transistor Mout. The illustrated adapter block is coupled in series between the sense transistor's drain terminal and the gate terminal of the leakage transistor Mleak. The adapter block is optional and it serves to make the leak transistor's gate voltage a nonlinear function of the sense transistor's drain voltage as described further below with reference to FIG. 4. (A short circuit or voltage divider can be used where a linear function is desired.)

In the embodiment of FIG. 2, an increase in the input voltage reduces the conductivity of the output and sense transistors, reducing the current provided to the output pin. The gate voltage of the leakage transistor is also reduced, raising the bulk node voltage and further reducing the conductivity of the output transistor, enabling the device's current draw to be minimized under conditions where low output currents are desired.

Conversely, a decrease in the input voltage increases the conductivity of the sense and output transistors, increasing the current provided to the output pin. The gate voltage of the leakage transistor is increased, lowering the bulk node voltage and further enhancing the conductivity of the output transistor, enabling the voltage drop across the output transistor to be minimized under conditions where high output currents are desired.

Note that the illustrated series arrangement of the bulk current adapter block is but one implementation. Any suitable arrangement that adjusts the bulk current based on the drain current of the sense transistor Ms (or indeed, on the drain current of the output transistor Mout) may alternatively be employed.

Figure 3:
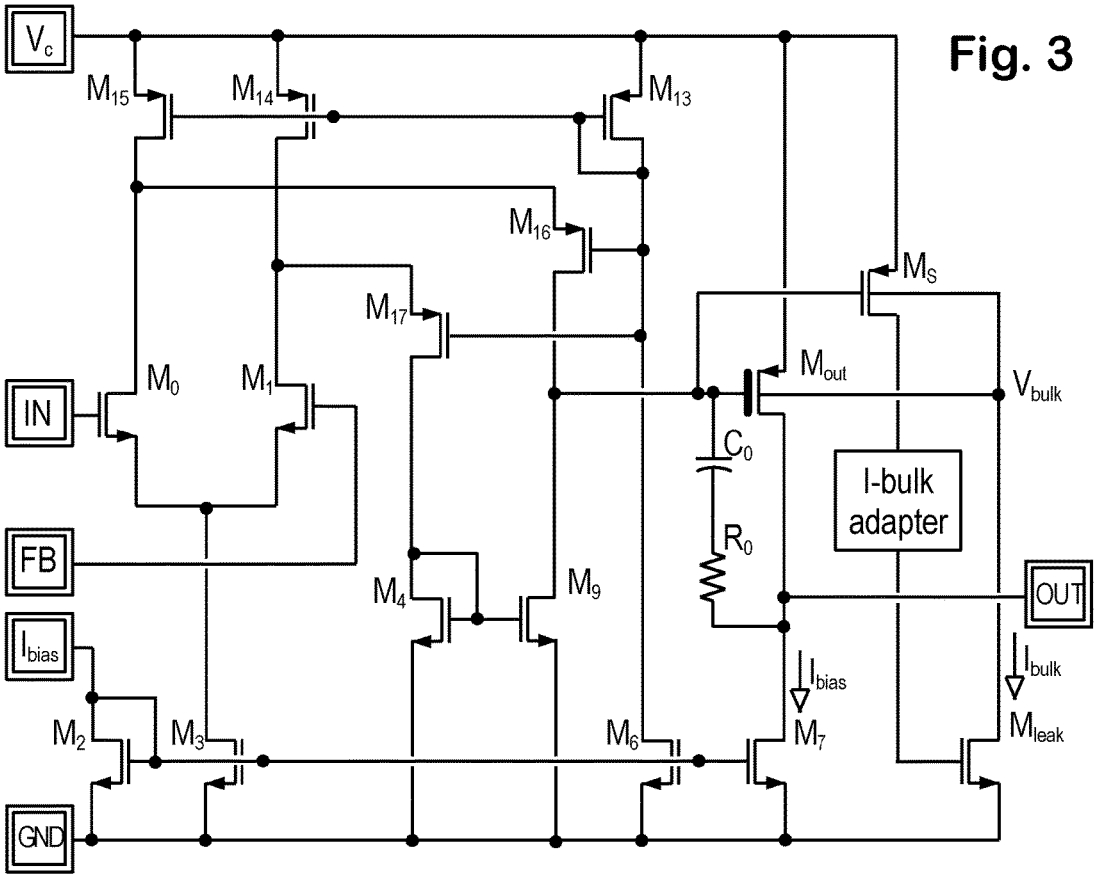
FIG. 3 is an internal schematic for an illustrative output stage of an LDO regulator with reduced dropout.

FIG. 3 shows an illustrative LDO regulator with feedback and bias current pins. As before, the regulator of FIG. 3 includes an output transistor Mout coupled between the supply voltage Vc and the output pin OUT. A sense transistor Ms has its source coupled to the supply voltage and its gate coupled to the gate of the output transistor. A bulk current adapter block couples the drain of the sense transistor to the gate of a leak transistor Mleak, which in turn controls the current flow (and hence voltage) for the body terminals of the output and sense transistors. The current sink of FIG. 2 is replaced by a transistor M7, which sinks a bias current from the output pin.

Transistor M7, along with transistors M6 and M3, are configured as current mirrors of bias current transistor M2, coupled between the current bias pin and ground. The gates of transistors M3, M6, and M7 are each coupled to the drain of transistor M2. Transistors M2, M3, M6, M7 and Mleak are each NMOS transistors.

Transistor M6 draws the bias current through a PMOS bias current transistor M13. PMOS transistors M14 and M15 are configured as current mirrors of transistor M13, and the gates of PMOS transistors M16, M17 are biased between bias transistors M6 and M13. With the biasing provided by transistors M3, M14, and M15, NMOS transistors M0 and M1 act as a differential amplifier. The gate of transistor M0 is coupled to the input pin IN, and the gate of transistor M1 is coupled to the feedback pin FB. As the feedback voltage rises beyond the input pin voltage, M1's drain voltage drops, reducing the current flow through transistor M17, which in turn reduces the conductivity of transistor M4 and its current mirror M9. M0's drain voltage increases, increasing the current flow through transistors M16 and M9. The output transistor's gate is coupled to the drain of transistor M9, so the gate voltage rises, reducing the current flow to the output pin. Conversely, as the feedback pin voltage falls below the input pin voltage, the output transistor's gate voltage falls, increasing the current flow to the output pin.

The regulator of FIG. 3 further includes a capacitor C0 and resistor R0 in series between the output transistor's gate and the output pin OUT. These components provide frequency compensation for the LDO output stage.

It is desirable to minimize the device's quiescent current Iq (the ground current when the output current is zero) and to minimize the maximum dropout (the voltage drop across the output transistor at the maximum rated output current). For a given input voltage and supply voltage, the gate voltage of the output transistor corresponds (inversely) to the output current. To reduce quiescent current without increasing the maximum dropout, the bulk current is related to the output current via the sense transistor Ms and the bulk current adapter block.

Figure 4:
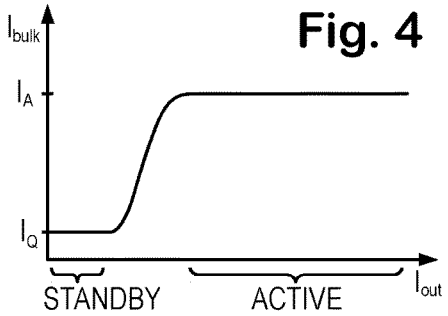
FIG. 4 is a graph of an illustrative bulk current adaptation function.

FIG. 4 shows an illustrative relationship between output current Iout and bulk current Ibulk. A low-current region of the output current axis is designated as the Standby region, and a typical operating current region of the axis is designated as the Active region. The actual ranges for these regions depends on the intended application of the device and the threshold at which the bulk current can be treated as a negligible fraction of the ground current from other components. In the Standby region, the bulk current is kept at the minimum quiescent value (e.g., less than 100 nA), whereas in the Active region, the bulk current is kept at the operating value where acceptable dropout performance is achieved (e.g., 5-10 uA). Other considerations for the chosen bulk current levels include dynamic performance and noise rejection, both of which are improved with higher current levels, and neither of which is important when the system is in standby mode. For very stringent performance requirements, one or more intermediate operating regions may be provided where the bulk current plateaus between the minimum and maximum bulk currents. The transition between the Standby and Active regions can have any suitable shape, though a smooth monotonic curve is preferred. The adapter block may employ transistors, biased and level-shifted as necessary, to provide the desired function.

Figure 5:
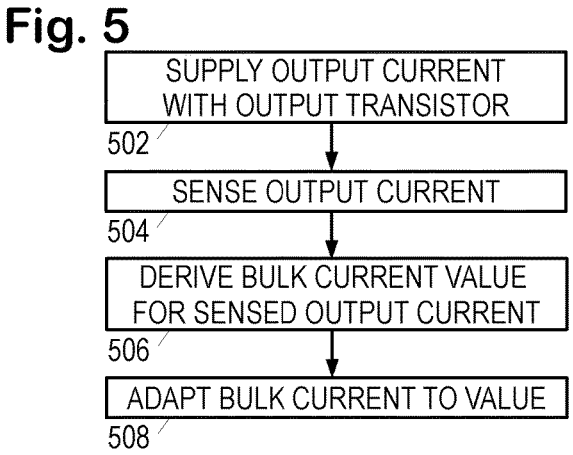
FIG. 5 is a flowchart of an illustrative bulk current regulation method.

FIG. 5 is a flowchart of an illustrative bulk current regulation method. In block 502, the device supplies an output current using an output transistor. In block 504, the device senses the drain-source current of the output transistor, in some embodiments using the output transistor's gate voltage to represent the output current. In block 506, the device derives a suitable bulk current target based on the sensed output current. As discussed previously, the bulk current is maintained at an elevated operating value while the output current is in an active range, and the bulk current is reduced for output currents outside this range. The bulk current may be maintained at a quiescent value while the output current is in a standby range. Plateaus at intermediate bulk current values may be provided for intermediate output current ranges. In block 508, the device adapts the bulk current to the target value. Though the operations of FIG. 5 are shown as being sequential, it is expected that they will occur concurrently in practice.

When the disclosed bulk current regulation technique is applied to existing designs, it is expected that significantly lower LDO dropouts will be achieved. The disclosed techniques may also be employed as a way to significantly reduce die area while maintaining an LDO dropout, or as a way to reduce both die area and LDO dropout. Though described above for use with a PMOS output transistor, the disclosed technique is also applicable to NMOS output transistors, or with any suitable integrated field effect transistor.

In a simulation trial using an LDO regulator fabricated with a 5.5V process, maximum dropout was set to 190 mV. With Vout=1.45V and the operating value of Ibulk set to 3 uA, the areal requirement for the output transistor was reduced by 40% for the same dropout. If, for example, the output transistor occupied 50% of the total die area, this technique enables the total die area to be reduced by 20%. With Ibulk kept at 3 uA, at Vout=2.2V the output transistor size reduction was 23%, and at Vout=3V, the reduction was 15%. To illustrate how the Ibulk influences dropout, we note the 190 mV dropout for the original design (at Vout=1.45V) required Ibulk=1 uA. Increasing Ibulk to 27 uA reduced the dropout to 174 mV.

Though the disclosed technique is discussed in the particular context of LDO regulators, it is applicable to other integrated circuit devices. These and numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A method for improving performance of a metal-oxide-semiconductor (MOS) output transistor, the method comprising:

sensing a source-drain current provided by the output transistor, wherein said sensing includes:

coupling a gate signal of the output transistor to a gate of a sense transistor to derive a control voltage from a conductivity of the sense transistor; and controlling a bulk current from a body terminal of the output transistor in response to the source-drain current, wherein said controlling includes:

supplying the control voltage to a gate of a leakage transistor coupled between the body terminal and a supply voltage or ground, the control voltage operating to:

maintain the bulk current at an operating value while the source-drain current is in an active range; and reduce the bulk current below the operating value when the source-drain current lies outside the active range.

2. The method of claim 1, wherein said leakage transistor is coupled between the body terminal and ground.

3. The method of claim 1, wherein said deriving includes coupling a drain of the sense transistor to the gate of the leakage transistor with an adapter block.

4. The method of claim 1, wherein the control voltage further operates to maintain the bulk current at a quiescent value when the source-drain current is in a standby range.

5. The method of claim 4, wherein the control voltage further operates to maintain the bulk current at an intermediate value when the source-drain current is in an intermediate range.

6. The method of claim 1, further comprising performing low dropout voltage regulation with the output transistor.

7. A circuit comprising:

an output transistor that supplies an output current over a range that includes an active region; and a bulk current adapter that senses the output current and, with a leakage transistor coupled between a body terminal of the output transistor and a supply voltage or ground, responsively controls a bulk current from the body terminal, maintaining the bulk current at an operating value while the output current is in the active region and reducing the bulk current when the output current is outside the active region, wherein as part of said reducing, the bulk current adapter maintains the bulk current at a quiescent value while the output current is in a standby region, and further maintains the bulk current at a predetermined intermediate value while the output current is in an intermediate region between the standby region and the active region.

8. The circuit of claim 7, wherein the bulk current adapter senses the output current via a sense transistor having a gate coupled to a gate of the output transistor.

9. The circuit of claim 8, wherein the output transistor and the sense transistor are PMOS transistors each having a source coupled to a supply voltage.

10. The circuit of claim 8, wherein the leakage transistor is coupled between the body terminal and ground.

11. The circuit of claim 8, wherein the output transistor and the sense transistor are NMOS transistors each having a source coupled to ground.

12. The circuit of claim 8, wherein the leakage transistor is coupled between the body terminal and a supply voltage.

13. The circuit of claim 7, wherein the circuit is a low dropout (LDO) regulator that regulates an output voltage with the output transistor.

14. A low dropout (LDO) regulator that comprises:

an output transistor coupled between a supply voltage and an output terminal, the output transistor having a gate and a body terminal;

a differential amplifier that provides an amplified difference between a reference voltage and a feedback voltage as a gate signal to the gate of the output transistor;

a sense transistor having a gate coupled to the gate of the output transistor and providing a drain current representing an output current of the output transistor; and a leakage transistor coupled between the body terminal and a supply voltage or ground to control a bulk current from the body terminal of the output transistor based on the drain current, wherein the leakage transistor maintains the bulk current at an elevated value when the output transistor is operating in an active range and reduces the bulk current when the output transistor is operating in a standby range.

15. A low dropout (LDO) regulator that comprises:

an output transistor coupled between a supply voltage and an output terminal, the output transistor having a gate and a body terminal;

a differential amplifier that provides an amplified difference between a reference voltage and a feedback voltage as a gate signal to the gate of the output transistor;

a sense transistor having a gate coupled to the gate of the output transistor and providing a drain current representing an output current of the output transistor;

a leakage transistor that controls a bulk current from the body terminal of the output transistor based on the drain current; and a bulk current adapter coupled between the sense and leakage transistors and operating to maintain the bulk current at an elevated value when the output transistor is operating in an active range and to reduce the bulk current when the output transistor is operating in a standby range.

16. The LDO regulator of claim 15, wherein the bulk current adapter implements the bulk current as a smooth monotonic function between a quiescent value for the standby range and the elevated value for the active range.

17. The LDO regulator of claim 14, wherein the output and sense transistors are PMOS, and wherein the leakage transistor is coupled between the body terminal and ground.

* * * * *